US012286327B1

(12) United States Patent
Zhao

(10) Patent No.: US 12,286,327 B1
(45) Date of Patent: Apr. 29, 2025

(54) RETRACTABLE DATA CABLE

(71) Applicant: Jiangxi Risheng Precision Hardware Co., Ltd, Jiangxi (CN)

(72) Inventor: Linqiang Zhao, Guangdong (CN)

(73) Assignee: Jiangxi Risheng Precision Hardware Co., Ltd, Yingtan (CN)

( * ) Notice: Subject to any disclaimer, the term of this patent is extended or adjusted under 35 U.S.C. 154(b) by 0 days.

(21) Appl. No.: 19/010,276

(22) Filed: Jan. 6, 2025

(30) Foreign Application Priority Data

Aug. 15, 2024 (CN) ..... 202421974275.0

(51) Int. Cl.
*B65H 75/44* (2006.01)
*B65H 75/40* (2006.01)

(52) U.S. Cl.
CPC ..... *B65H 75/406* (2013.01); *B65H 75/4402* (2013.01); *B65H 2701/34* (2013.01)

(58) Field of Classification Search
CPC .. B65H 75/44; B65H 75/406; B65H 75/4402; B65H 2701/34
See application file for complete search history.

(56) References Cited

U.S. PATENT DOCUMENTS

| | | | | |
|---|---|---|---|---|
| 9,499,373 | B1 * | 11/2016 | Kim | B65H 75/4402 |
| 2012/0126047 | A1 * | 5/2012 | Skowronski | H02G 11/02 242/388.6 |
| 2014/0263801 | A1 * | 9/2014 | Skowronski | B65H 75/4449 242/397.5 |
| 2017/0260021 | A1 * | 9/2017 | Hale | B65H 75/14 |
| 2018/0093852 | A1 * | 4/2018 | Morey | B65H 75/4452 |
| 2019/0256320 | A1 * | 8/2019 | Hinojosa | H02G 11/02 |
| 2022/0162037 | A1 * | 5/2022 | Yu | B65H 75/4402 |

* cited by examiner

*Primary Examiner* — Sang K Kim
(74) *Attorney, Agent, or Firm* — Nicholas Makridakis

(57) ABSTRACT

A retractable data cable is provided, including a housing, a conductive component, and a winding component. The winding component includes a first turntable and a second turntable, the first turntable is rotatably installed to a top surface of a first circuit board, the first turntable and the second turntable are clamped to respectively fix at a top surface and an undersurface of the conductive carrier, and a coil spring is installed on the second turntable. The data cable is wrapped on an outer side of the conductive carrier for fixation, and a plug component is fixedly installed at a leading-out terminal of the data cable. A positioning group is used to move the damaged area on the data cable due to frequent bending to the interior of the protective cover of the plug component for protection.

10 Claims, 9 Drawing Sheets

RETRACTABLE DATA CABLE

CROSS REFERENCE TO RELATED APPLICATION

This application claims priority to Chinese Patent Application No. 2024219742750, filed on Aug. 15, 2024, which is hereby incorporated by reference in its entirety.

TECHNICAL FIELD

The present application relates to the technical field of data cables, and more particularly to a novel retractable data cable.

BACKGROUND

People often carry electronic products such as mobile phones and tablets when going out. In order to charge the electronic products, people usually carry a power bank equipped with data cable. The common data cable has a long strip structure, which makes it difficult to store and even causes knotting and entanglement when not in use. To solve such problems, a retractable data cable has been designed and published on the market, for example, Chinese patent CN 215732537U discloses a unidirectional free-pulling data cable, by winding the data cable onto the wheel core, a clamping assembly is provided on the outer side of the wheel cover at the top of the wheel core, the clamping assembly is used to cooperate with the elastic member to control the forward and backward rotation of the wheel core, thereby achieving automatic extension and retraction of the data cable.

However, during use of the retractable data cable, frequent bending at the connection between the plug and the data cable may cause the protective layer at the data cable joint to crack, resulting in the exposure of internal optical fibers and wires. Moreover, the tensile force of the retractable data cable at the cracking point of the protective layer will exacerbate the severity of data cable damage, affecting the normal and safe use of the data cable. In addition, the winding and extension range of the retractable data cable is constrained by the elastic member, which is not conductive to stretching the data cable for a long distance in special situations far away from the power socket.

SUMMARY

The present disclosure aims to provide a novel retractable data cable to address the problems raised in the background.

To achieve above objectives, the present disclosure adopts the following technical solutions.

In some embodiments of the present disclosure, a novel retractable data cable is provided, including a housing and a conductive component. Herein the housing includes a first circuit board, a housing base is fixed on a top of the first circuit board, and a second circuit board is fixed on a top of the housing base. The conductive component is installed between the first circuit board and the housing base, the conductive component includes a conductive shaft, and an outer side of the conductive shaft is rotatably sleeved with a conductive carrier.

In some embodiments of the present disclosure, the novel retractable data cable further includes a winding component, a data cable, a pug component, a positioning group, and a clamping component.

Herein the winding component is rotatably connected to a top surface of the first circuit board, and the winding component includes a first turntable and a second turntable, the first turntable and the second turntable are clamped to respectively fix at both ends of the conductive carrier, and a coil spring is installed on the second turntable.

Herein the data cable is wrapped on an outer side of the conductive carrier for fixation.

Herein the plug component is fixedly installed at a leading-out terminal of the data cable, and the plug component includes a fixed sleeve detachably fixed to the data cable, one end of the fixed sleeve is fixedly connected with a protective cover, and one end of the protective cover is fixed with a plug.

Herein the positioning group is installed inside the protective cover and configured to pull the data cable to move into an interior of the fixed sleeve.

Herein the clamping component is disposed in an inner top of the housing base and configured to clamp and fix the winding component being in a rotating state.

In some preferred embodiments of the present disclosure, two first convex columns and two second convex columns are fixed on a top surface of the first turntable, and the first convex columns and the second convex columns pass through a conductive holder to fix with the second turntable.

In some preferred embodiments of the present disclosure, the interior of the fixed sleeve is slidably snap-fitted with a splint, and an outer side of the fixed sleeve is threadable fastened with a stud being rotated with the splint.

In some preferred embodiments of the present disclosure, the positioning group includes a base, a shaft, a latch, and a telescopic rod.

Herein the base is fixed on the interior of the protective cover, two first rollers and two second rollers are rotatably provided on a top surface of the base, and the data cable is wound between the first rollers and the second rollers for transmission.

Herein the shaft is rotatably inserted with a corresponding second roller, and a wedge block is fixedly sleeved on an outer side of the shaft.

Herein the latch is sliding engaged with the wedge block.

Herein the telescopic rod is provided with two, an output end of each telescopic rod is fixed to the latch, and another end of each telescopic rod is fixed to the protective cover.

In some preferred embodiments of the present disclosure, a magnet is fixed on an outer side of the housing base, and an iron sheet is fixedly embedded on an outer side of the plug.

In some preferred embodiments of the present disclosure, a connecting shaft is rotatably connected to a top of the conductive shaft, an inner side of the second turntable is fixed with a pillar, and two ends of the coil spring are fixedly connected to the connecting shaft and the pillar, respectively.

In some preferred embodiments of the present disclosure, the winding component further includes a drive column fixedly fastened with the connecting shaft, and the drive column passes through one end of the second circuit board to slidably connect with a slider.

In some preferred embodiments of the present disclosure, the clamping component includes a swing arm, a flexure piece, and a rotating wheel.

Herein the swing arm is rotatably installed at an inner top of the housing base, wherein an outer side of the swing arm is slidably engaged with risen mouldings, and a top surface of the swing arm is fixed with a first lug and a second lug.

Herein the flexure piece is fixed on a top of the swing arm.

Herein the rotating wheel is rotatably installed between the first lug and the second lug.

In some preferred embodiments of the present disclosure, an outer side of the second turntable is provided with a plurality of notches movable snap-fitted with the risen mouldings, and an interior of the swing arm is threadable fastened with a screw rotatably connected with the risen mouldings.

In some preferred embodiments of the present disclosure, the rotating wheel is rotatably connected to the inner top of the housing base, and an outer side of the rotating wheel is provided with first slots and second slots.

Compared with the existing technologies, the novel retractable data cable of the present disclosure has at least the following beneficial effects.

1. By slidably holding the slider at the top of the drive column to allow the middle of the coil spring and the drive column can rotate on the circuit board, at this time the coil spring no longer provides a reverse elastic force to the rotated winding component to rotate its initial position. Then, manually push the two ends of the shaft to slide the wedge block on the outer side of the shaft along the caliper. The second rollers on the outer side of the shaft stretch the data cable towards the interior of the protective cover, allowing the data cable near one end of the fixed sleeve to be stored and moved to a certain distance to the interior of the protective cover. Thus, the frequently bent and damaged areas on the data cable can be moved to the interior of the protective cover for protection, and the intact position on the data cable can be moved to the fixed sleeve near the plug component, effectively preventing the internal optical fibers and wires from being exposed.

2. By rotating the stud with an external screwdriver to move the splint towards a direction of the data cable, causing the splint to press and fix the data cable to the interior of the fixed sleeve. After adjusting the position of the data cable by the positioning group, the fixed sleeve can be fixed at the rear end of the damaged data cable. When pulling the plug component by hand, the tension of the data cable is applied to the rear of the damaged area of the data cable through the fixed sleeve, effectively preventing the tension of the data cable from acting on the crack of the protective layer and aggravating the severity of the data cable damage.

3. By rotating the screw to slide the risen mouldings into the interior of the swing arm, the clamping component is no longer clamped to the winding component in a fixed rotating state. Then, pulling the plug component can pull out all data cables wrapped around the outside of the winding component, achieving the use of long distance data cables.

4. By rotating the stud in the opposite direction, the risen mouldings are engaged with the notches on the outer side of the driving wheel. The slider at the top of the sliding column is slid and inserted into the rectangular slot at the corresponding position on the second circuit board. The middle of the coil spring is fixed to the second circuit board through the drive column, and the outer side of the coil spring is fixed to the inner side of the second turntable through the pillar. During the process of pulling out the data cable, the coil spring will enwind and store energy. At the same time, the clamping component can fix the winding component after releasing the data cable, allowing the data cable to be stretched out for short distance use. Then, pull the data cable again, the clamping component is no longer fixed the winding component. At this time, under the elastic force of the coil spring, the winding component reels the data cable, making it easier to automatically retract the data cable and achieve a switch use between long distance and short distance of the data cable.

Figure 1:
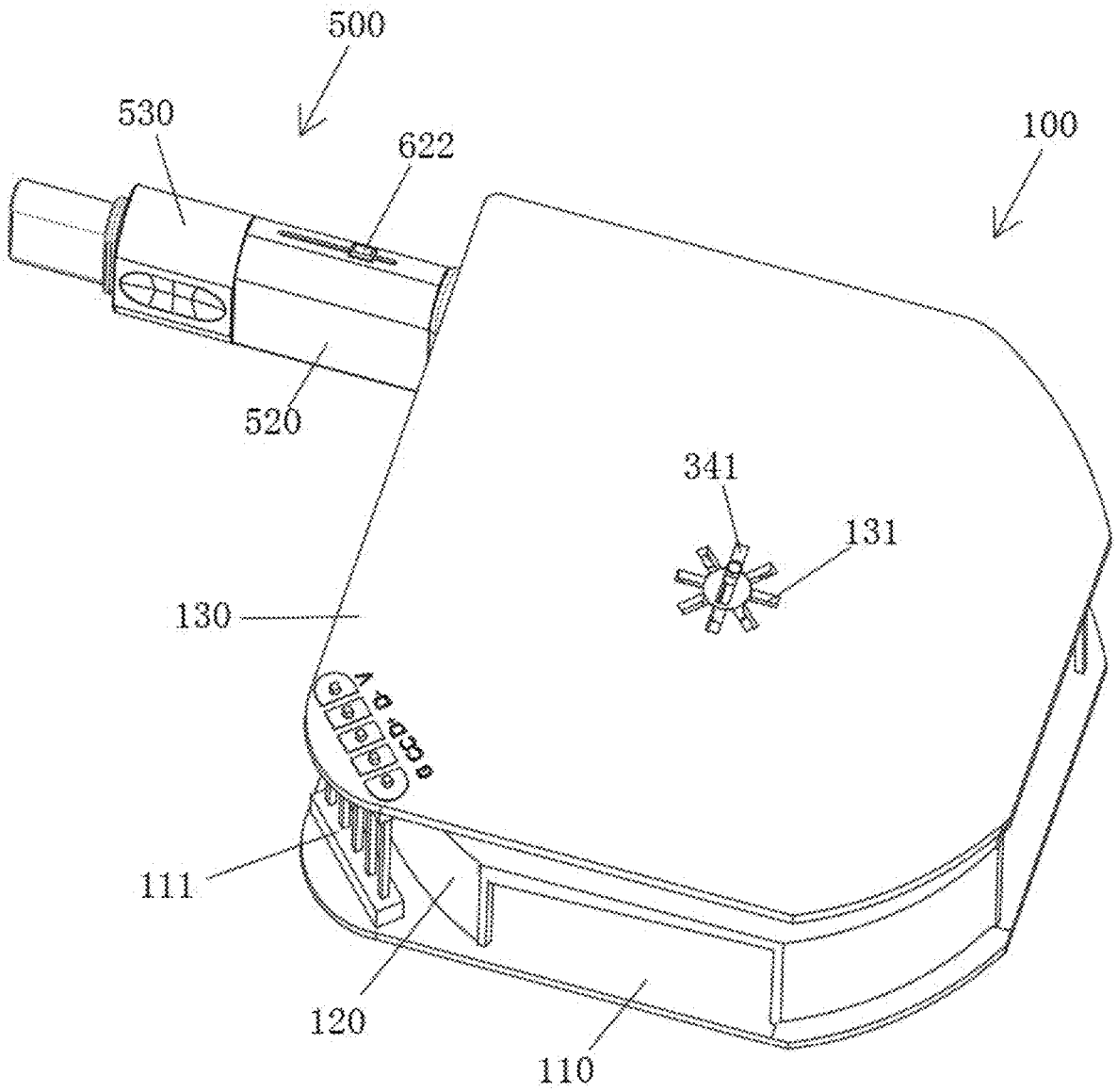
FIG. 1 shows a schematic diagram of an overall structure of a retractable data cable in accordance with some embodiments of the present disclosure.

In the drawings, reference numerals are as follows.

100. Housing, 110. First circuit board, 111. Pin connector, 120. Housing base, 121. Magnet, 122. First locating shaft, 123. Second locating shaft, 124. Mounting groove, 130. Second circuit board, 131. Rectangular slot.

200. Conductive component, 210. Conductive shaft, 211. Connecting shaft, 220. Conductive carrier.

300. Winding component, 310. First turntable, 311. First convex column, 312. Second convex column, 320. Second turntable, 321. Notch, 322. Pillar, 330. Coil spring, 340. Drive column, 341. Slider, 342. Insert block.

400. Data cable.

500. Plug component, 510. Fixed sleeve, 511. Splint, 512. Stud, 520. Protective cover, 530. Plug.

600. Positioning group, 610. Base, 611. First roller, 612. Second roller, 620. Shaft, 621. Wedge block, 622. Pull block, 630. Latch, 640. Telescopic rod.

700. Clamping component, 710. Swing arm, 711. Risen moulding, 712. First lug, 713. Second lug, 714. Screw, 720. Flexure piece, 730. Rotating wheel, 731. First slot, 732. Second slot.

DETAILED DESCRIPTION OF THE EMBODIMENTS

The following will clearly and completely describe the technical solutions in the embodiments of the present disclosure in conjunction with the accompanying drawings. Obviously, the described embodiments are only a part of the embodiments of the present disclosure, and not all of them. Based on the embodiments of the present disclosure, all other embodiments obtained by one of ordinary skill in the art without creative labor shall fall within the scope of protection of the present invention.

Referring to FIG. 1 to FIG. 9, in some embodiments of the present disclosure, a novel retractable data cable is provided, including a housing 100. The housing 100 includes a first circuit board 110, a housing base 120 is fixed on a top of the first circuit board 110, and a second circuit board 130 is fixed on a top of the housing base 120. A conductive component 200 is installed between the first circuit board 110 and the housing base 120, the conductive component 200 includes a conductive shaft 210, and an outer side of the conductive shaft 210 is rotatably sleeved with a conductive carrier 220. Moreover, the novel retractable data cable further includes a winding component 300, and the winding component 300 includes a first turntable 310 and a second turntable 320. The first turntable 310 is rotatably connected to a top surface of the first circuit board 110, the first turntable 310 and the second turntable 320 are clamped to respectively fix at a top surface and a bottom surface of the conductive carrier 220. A coil spring 330 is installed on the second turntable 320, and a data cable 400 is wrapped on an outer side of the conductive carrier 220 for fixation. A plug component 500 is fixedly installed at a leading-out terminal of the data cable 400, the plug component 500 includes a fixed sleeve 510 detachably fixed to the data cable 400, one end of the fixed sleeve 510 is fixedly connected with a protective cover 520, and one end of the protective cover 520 is fixed with a plug 530. A positioning group 600 is installed inside the protective cover 520, and a clamping component 700 is disposed in an inner top of the housing base 120 for clamping and fixing the winding component 300.

Specifically, by movable arranging the existing publicly available clamping component 700 on the outer side of the winding component 300, it can facilitate the automatic pulling and retraction of the data cable for short distances when the clamping component 700 is movable clamped with the winding component 300. And when the clamping component 700 is separated from the winding component 300, it is easy to pull out the data cable 400 from the winding component 300 for long distances, allowing the data cable to be used for long distances and expanding the use range of the retractable data cable. By the positioning group 600, the damaged area on the data cable 400 due to frequent bending is moved to the interior of the protective cover 520 of the plug component 500 for protection, preventing further damage to the damaged area on the data cable 400 by pulling the data cable through the plug component 500. The intact area on the data cable 400 is moved to the position of the fixed sleeve 510 for clamping and fixing, the pulling force of the data cable is applied on the rear of the damaged area on the data cable 400, further preventing the pulling force of the data cable from acting on the cracked and damaged area of the protective layer and aggravating the damage of the data cable, which is beneficial for extending the service life of the data cable.

Figure 8:
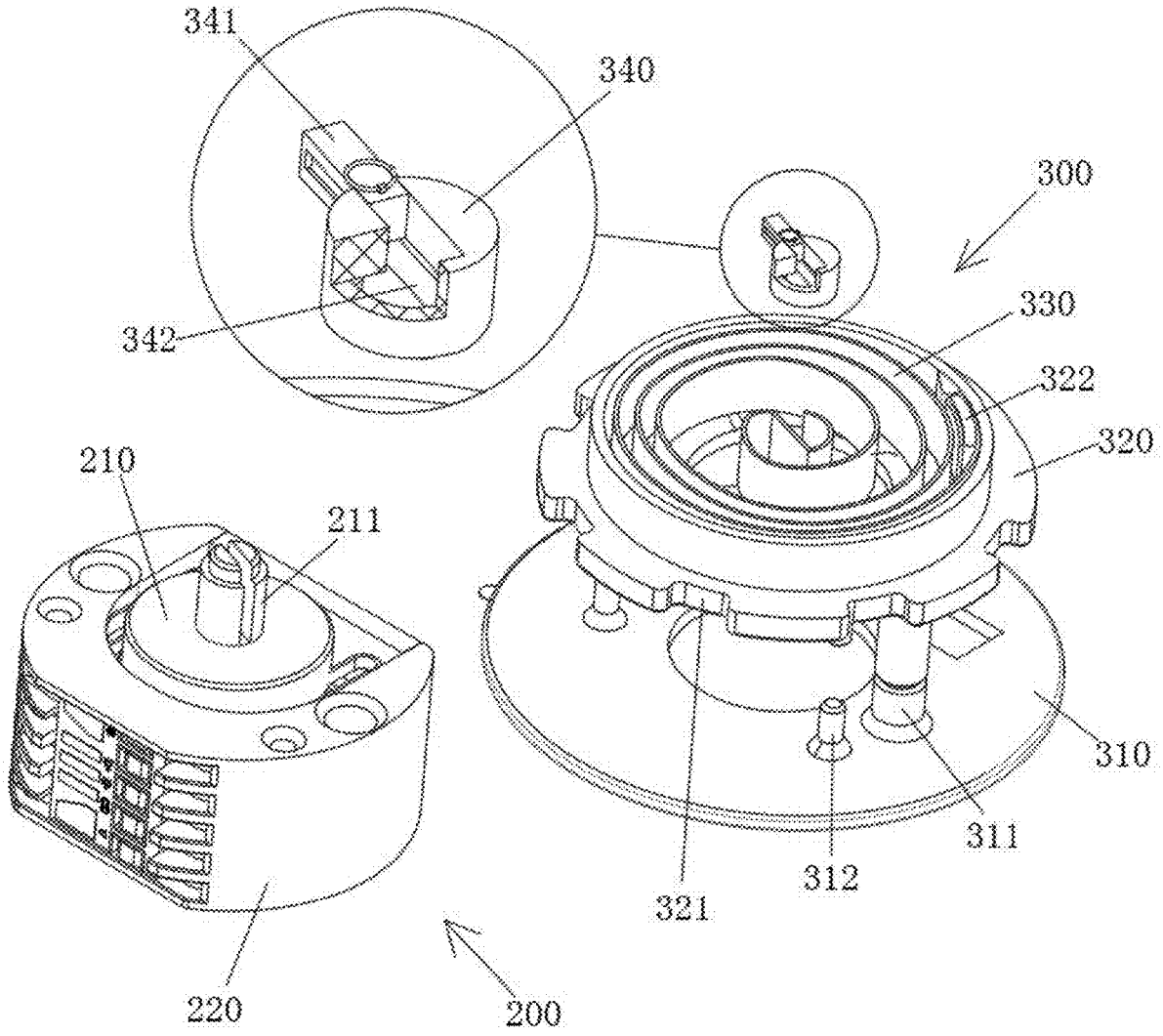
FIG. 8 shows a structural schematic diagram of a conductive component and a winding component in accordance with some embodiments of the present disclosure.

Referring to FIG. 8, in some embodiments of the present disclosure, two first convex columns 311 and two second convex columns 312 are fixed on a top surface of the first turntable 310, and the undersurface of the second turntable 320 is provided with two sleeves, the first convex columns 311 run through the conductive carrier 220 and are fixedly inserted into the sleeves, thereby fixedly clamping the conductive carrier 220 between the first turntable 310 and the second turntable 320.

Figure 2:
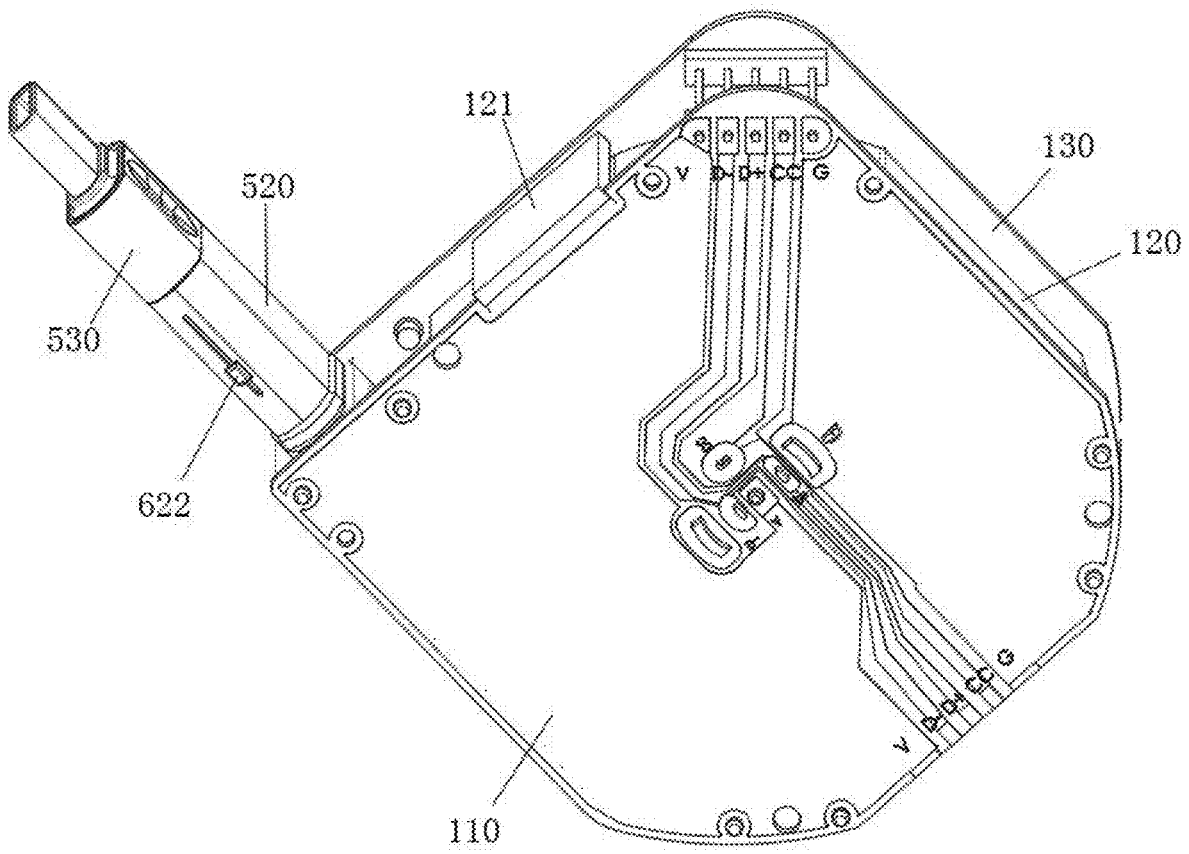
FIG. 2 shows another schematic diagram of the overall structure of the retractable data cable in accordance with some embodiments of the present disclosure.

Referring to FIG. 1, FIG. 2, and FIG. 8, in some embodiments of the present disclosure, the conductive carrier 220 is rotatably sleeved on the outer side of the conductive shaft 210, which enables the conductive carrier 220 to rotate and be powered on. The conductive carrier 220 is electrically connected to the winding end of the data cable 400, providing electrical energy to the data cable. The bottom surface of the first circuit board 110 is fixed to conductive antennae, which is used to deliver external power to the position of the conductive shaft 210. A pin connector 111 is electrically connected between the first circuit board 110 and the second circuit board 130, allowing the two circuit boards to be electrically connected. Herein the components such as conductive shaft 210, the conductive carrier 220, the conductive antennae, and the pin connector 111 are all existing technologies, and their specific principle of transmitting electrical energy will not be described in detail.

Figure 7:
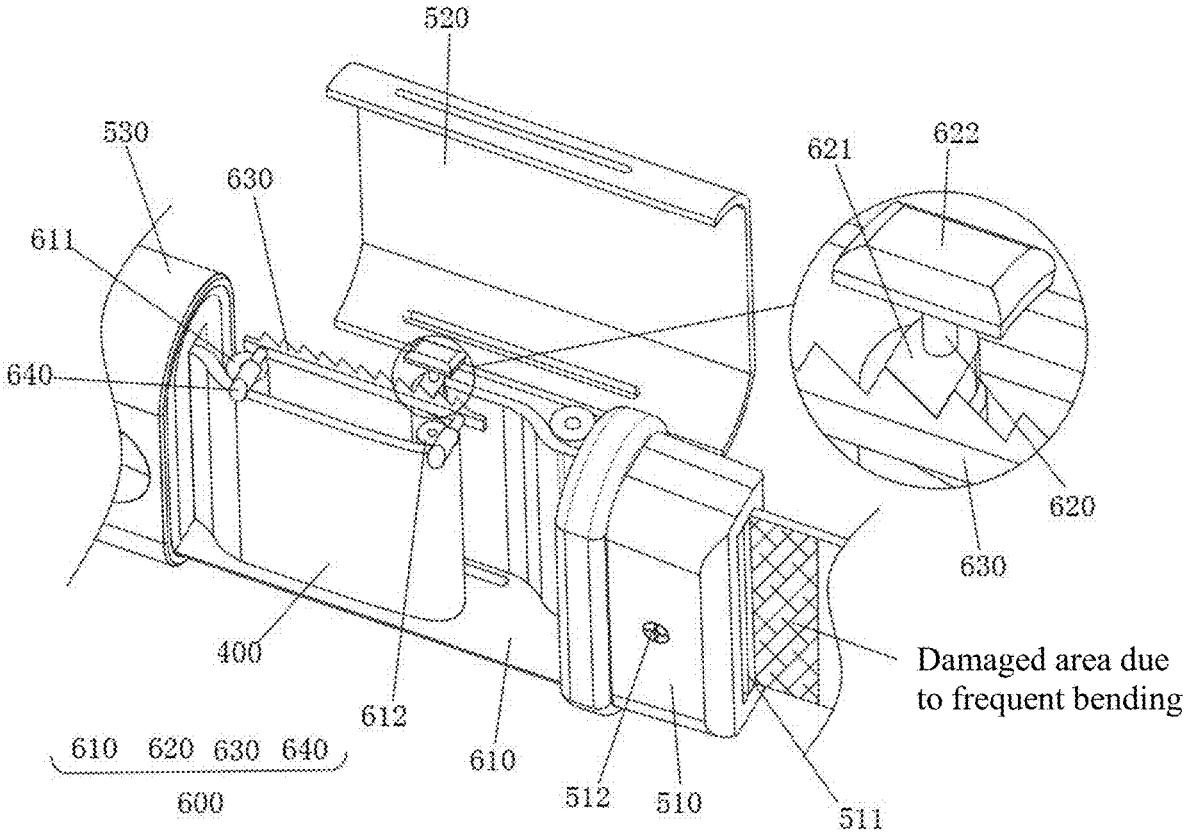
FIG. 7 shows a schematic diagram of an interior structure of a protective cover in accordance with some embodiments of the present disclosure.

Referring to FIG. 7, in some embodiments of the present disclosure, the interior of the fixed sleeve 510 is slidably snap-fitted with a splint 511, and an outer side of the fixed sleeve 510 is threadable fastened with a stud 512 which is rotated with the splint 511. When adjusting the position of the data cable 400 by using the positioning group 600, the stud 512 is loosened in advance to release the data cable 400 from the splint 511. After moving the damaged area on the data cable to the interior of the protective cover 520, the stud 512 is tighten to make the stud 512 along with the splint 511 compress the data cable 400, so that the data cable 400 is clamped and fixed inside the fixed sleeve 510.

Referring to FIG. 7, in some embodiments of the present disclosure, the positioning group 600 includes a base fixed on the inner bottom of the protective cover 520, two first rollers 611 and two second rollers 612 are rotatably provided on a top surface of the base 610, and the data cable 400 is wound between the first rollers 611 and the second rollers 612 for transmission. A shaft 620 is rotatably inserted into a middle of a corresponding second roller 612, and a wedge block 621 is fixedly sleeved on an outer side of the shaft 620. The interior of the protective cover 520 is provided with a latch 630 that slides and engages with the wedge block 621, and two telescopic rods 640 is fixed between the latch 630 and the protective cover 520.

In some embodiments of the present disclosure, by manually pulling the pull blocks 622 at both ends of the shaft 620, the data cable 400 is pulled towards the interior of the protective cover 520 through the second rollers 612. This allows the damaged area of the data cable 400 that near the fixed sleeve 510 to be moved to the interior of the protective cover 520 for protection. During the movement of the shaft 620, the wedge block 621 on the outer side of the shaft 620 slides along the latch 630, and the teeth on the latch 630 are also wedge-shaped. The latch 630 uses the telescopic rod 640 (existing member, that is a spring telescopic rod) to flexibly contact with the wedge block 621, so the latch 630 can fix the wedge block 621 in its moved position, thereby keeping the shaft 620 be fixed in position after movement, allowing the data cable 400 to be stably stored in the interior of the protective cover 520.

Referring to FIG. 1 and FIG. 2, in some embodiments of the present disclosure, a magnet 121 is fixed on an outer side of the housing base 120, and an iron sheet is fixedly embedded on an outer side of the plug 530. When the data cable is in storage and not in use, the plug component 500 can be magnetically fixed to the magnet 121 for convenient storage of the plug component 500.

Figure 3:
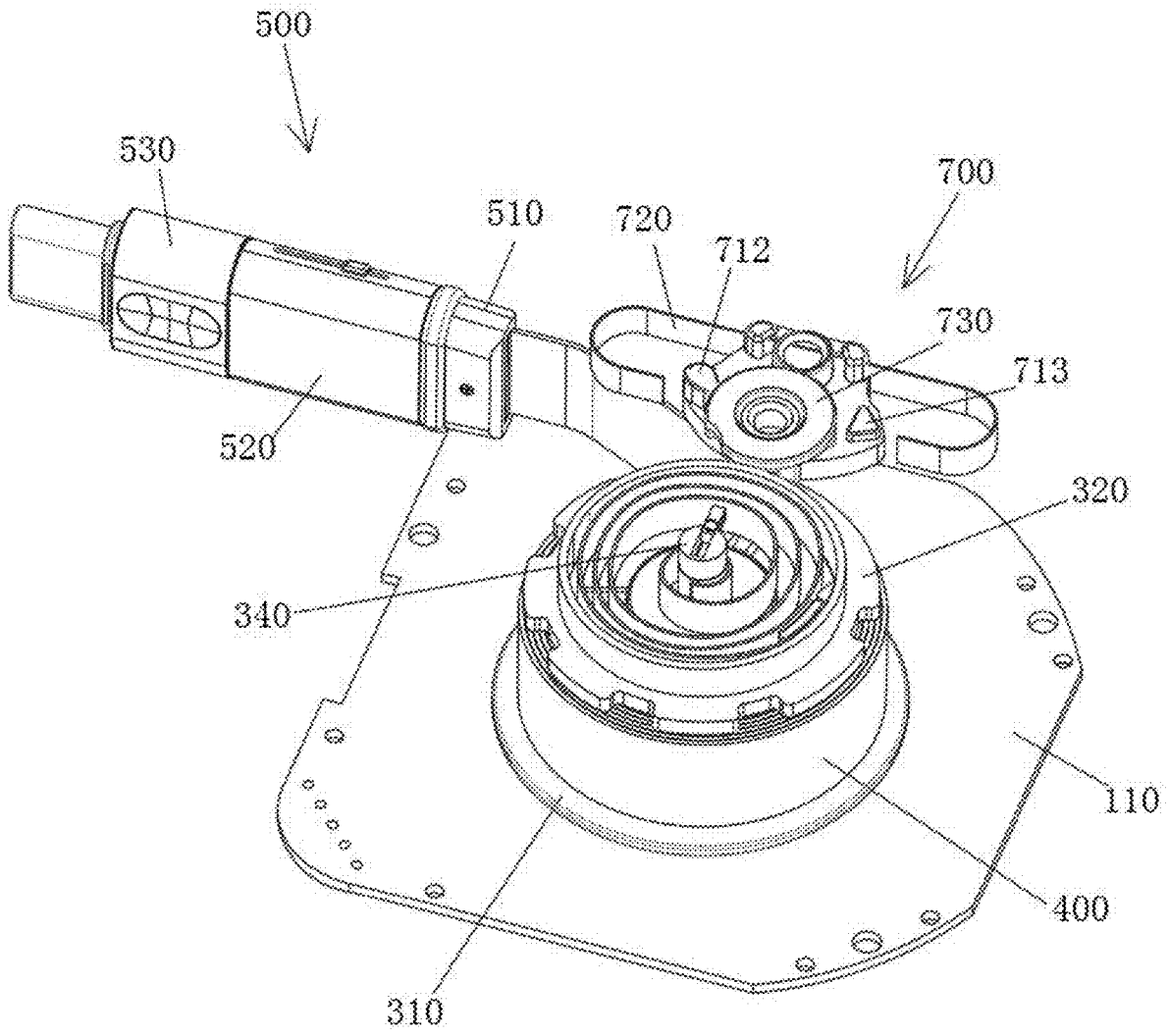
FIG. 3 shows a schematic diagram of a top structure of a first circuit board in accordance with some embodiments of the present disclosure.

Referring to FIG. 3 and FIG. 8, in some embodiments of the present disclosure, a connecting shaft 211 is rotatably connected to a top of the conductive shaft 210, an inner side of the second turntable 320 is fixed with a pillar 322, and two ends of the coil spring 330 are fixedly connected to the connecting shaft 211 and the pillar 33, respectively. In this way, one end of the coil spring 330 is fixed to the connecting shaft 211, and the other end of the coil spring 330 is fixed to the second turntable 320. The connecting shaft 211 is fixed to the second circuit board 130 through the drive column 340. When the second turntable 320 rotates to release the data cable, the second turntable 320 will rotate with the coil spring 330 to collect and store energy. The elastic potential of the coil spring 330 can facilitate the reverse automatic rotation of the second turntable 320 in the later stage to collect the released data cable.

Referring to FIG. 1 and FIG. 8, in some embodiments of the present disclosure, the winding component 300 further includes a drive column 340 fixedly fastened with the connecting shaft 211, and the drive column 340 passes through one end of the second circuit board 130 to slidably connect with a slider 341. The slider 341 is slid to make it inserted into the rectangular slot 131 of the second circuit boar 130, at this time, the connecting shaft 211 cannot rotate on the housing 100, which is beneficial for fixing the middle of the coil spring 330, allowing the coil spring 330 to rotate in the opposite direction after the winding component 300 rotates.

In some embodiments of the present disclosure, a wristband is fixed on the surface of the slider 341 for easy sliding the slider 341. After sliding the slider 341 away from the rectangular slot 131, the drive column 340 can rotate on the second circuit board 130, causing the connecting shaft 211 to no longer be in a fixed state, and the middle of the coil spring 330 to be in an active rotating state. At this time, the winding component 300 rotates to wind up or release the data cable without being affected by the coil spring 330. And the damaged area on the data cable is moved to the interior of the protective cover 520, which will not cause the coil spring 330 to wind up and store energy, and also convenient to release the data cable for long distances. Further, by rotating the drive column 340, longer data cable can also be wound up.

In some embodiments of the present disclosure, the top of the connecting shaft 211 is provided with a notch for easy clamping the coil spring 330, and the bottom of the drive column 340 is fixed with an insert block 342 for clamping with the notch, allowing the drive column 340 to control whether the connecting shaft 211 rotates or not.

Figure 9:
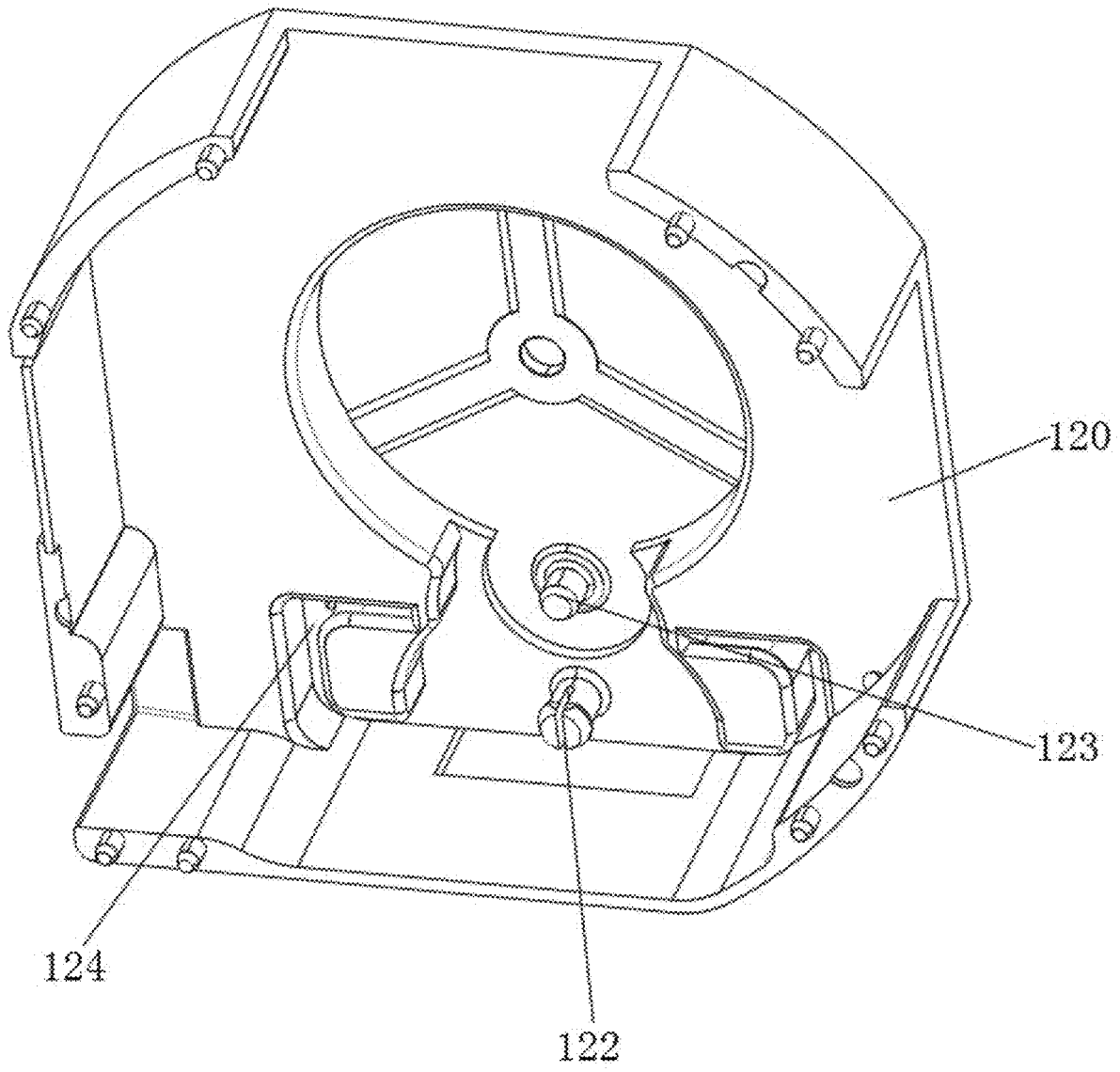
FIG. 9 shows a structural schematic diagram of a housing base in accordance with some embodiments of the present disclosure.

Referring to FIG. 9, in some embodiments of the present disclosure, the inner top of the housing base 120 is fixed with a first locating shaft 122 for rotatable installing the swing arm 710, the inner top of the housing base 120 is fixed with a second locating shaft 123 for rotatable installing the rotating wheel 730, and the inner top of the housing base 120 is provided with a mounting groove 124 for receiving a flexure piece 720.

In some other embodiments of the present disclosure, in order to clamp and fix the winding component 300 after releasing the data cable, the following structures are also provided.

Figure 4:
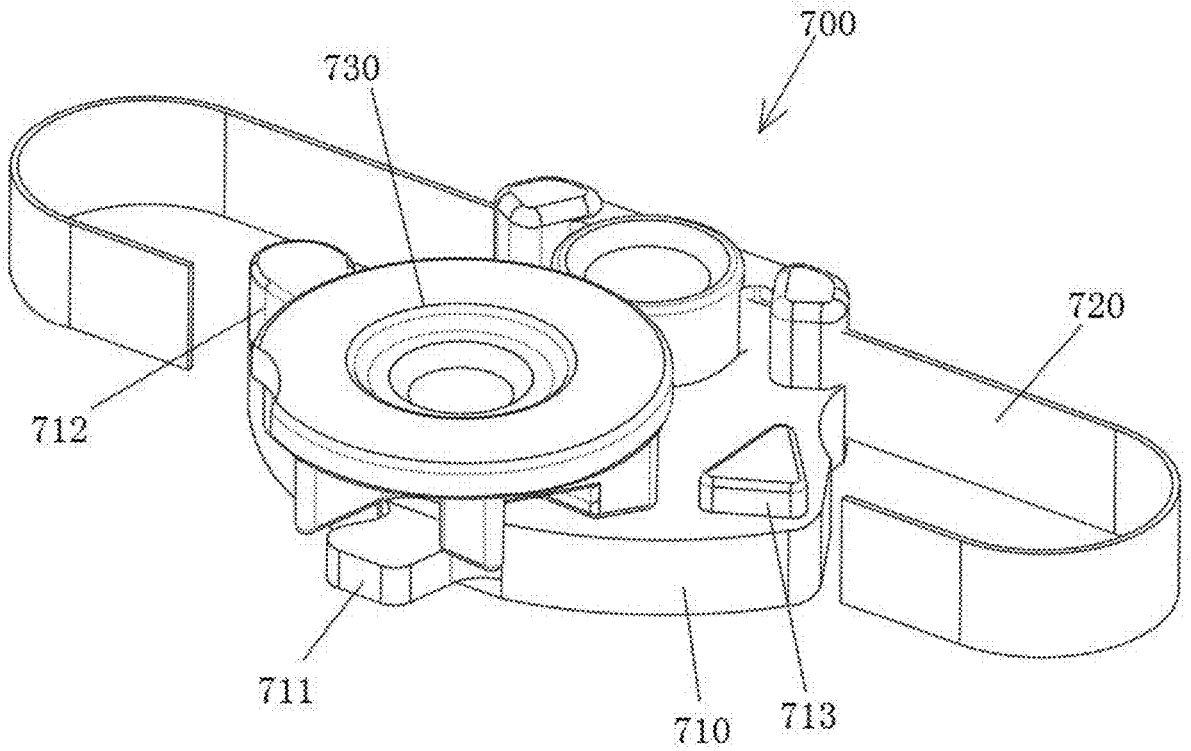
FIG. 4 shows a structural schematic diagram of a clamping component in accordance with some embodiments of the present disclosure.
Figure 6:
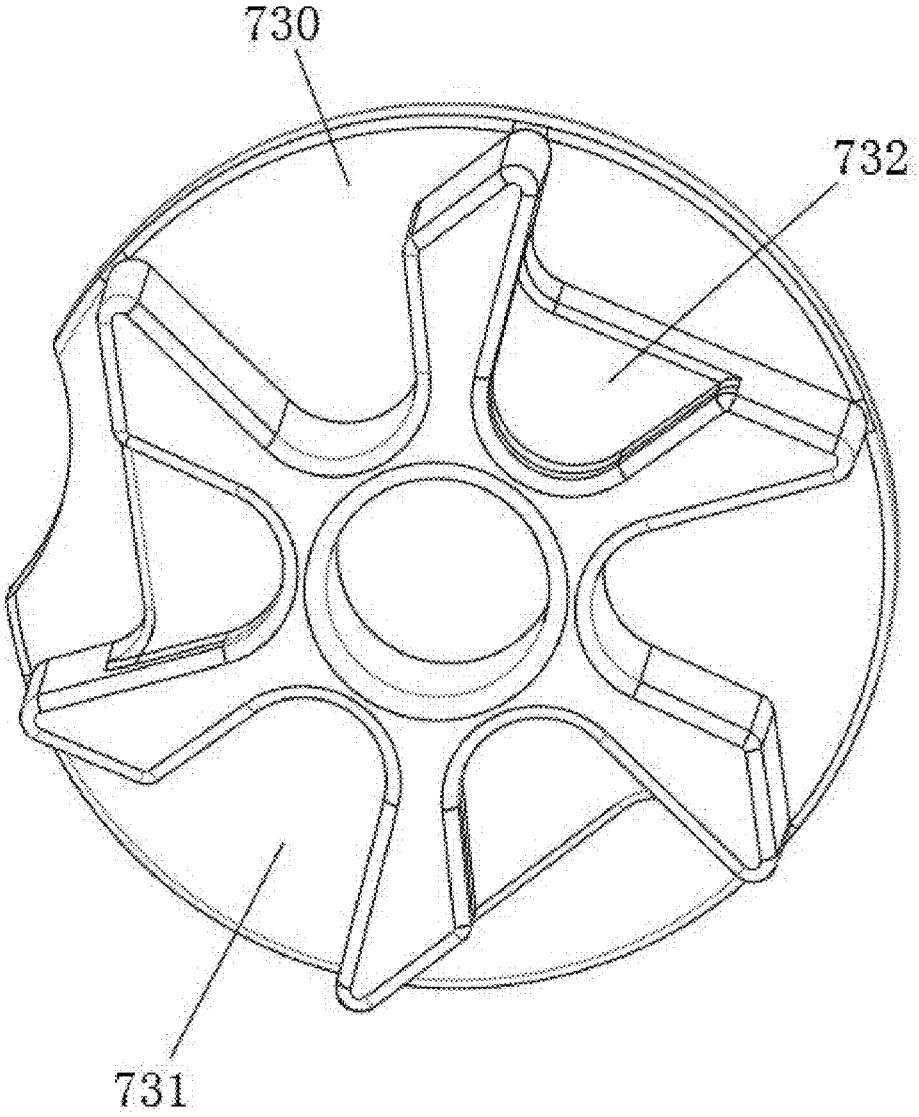
FIG. 6 shows a structural schematic diagram of a rotating wheel in accordance with some embodiments of the present disclosure.

Referring to FIG. 3, FIG. 4, and FIG. 6, in some other embodiments of the present disclosure, the clamping component 700 includes a swing arm 710 that is rotatably connected to the inner top of the housing base 120. The outer side of the swing arm 710 is slidably clamped with risen mouldings 710, the outer side of the second turntable 320 is provided with multiple notches 321 that are movable engaged with the rising mouldings 711. The top surface of the swing arm 710 is fixed with the first lug 712 and the second lug 713, the top of the swing arm 710 is fixed with a flexure piece 720, both ends of the flexure piece 720 are in contact with the inner side of the house base 120. The rotating wheel 730 is provided between the first lug 712 and the second lug 713, to rotatably connect with the housing base 120. The outer side of the rotating wheel 730 is provided with the first slots 731 and the second slots 732, with the first slots 731 having a depth greater than the second slots 732.

Specifically, during the process of using the clamping component 700 to retract and release the data cable, when releasing the data cable, the plug component 500 is used to pull the data cable. The data cable rotates with the second turntable 320, causing the risen mouldings 711 on the swing arm 710 to detach from the notches 321 on the second turntable 320. The swing arm 710 deviates from its initial position, and the flexure piece 720 undergoes deformation, providing a reset elastic force to the swing arm 710. After releasing the plug component 500, the elastic force of the coil spring 330 rotates the winding component 300 in the opposite direction to wind up the data cable. However, at this time, the swing arm 710 resets, and the second lug 713 on the swing arm 710 is engaged with the second slots 732 on the rotating wheel 730. Thus the swing arm 710 is limited and fixed, causing the winding component 300 to stop rotating.

When winding up the data cable, one end of the plug component 500 is pulled again, to allow the second turntable 320 rotate again, and the risen mouldings 711 on the swing arm 710 disengages from the notches 321, causing the swing arm 710 to deviate from its initial position. The flexure piece 720 provides the swing arm 710 a restoring force. After the user lets go, the second turntable 320 is reset under the action of the coil spring 330, and at the same time, the flexure piece 720 is reset with the swing arm 710. On the swing arm 710, the first lug 712 is engaged with the first slots 731, and the swing arm 710 is fixed again. Due to the depth of the first slots 731 is greater than that of the second slots 732, when the swing arm 710 is fixed, the angle at which the risen mouldings 711 on the swing arm 710 swings is greater than the angle at which the risen mouldings 711 swings during the data cable being loosen. Additionally, when the risen mouldings 711 stays outside of the notches 321 on the second turntable 320, it cannot prevent the second turntable 320 from rotating, and all data cable are retracted under the action of the coil spring 330.

Figure 5:
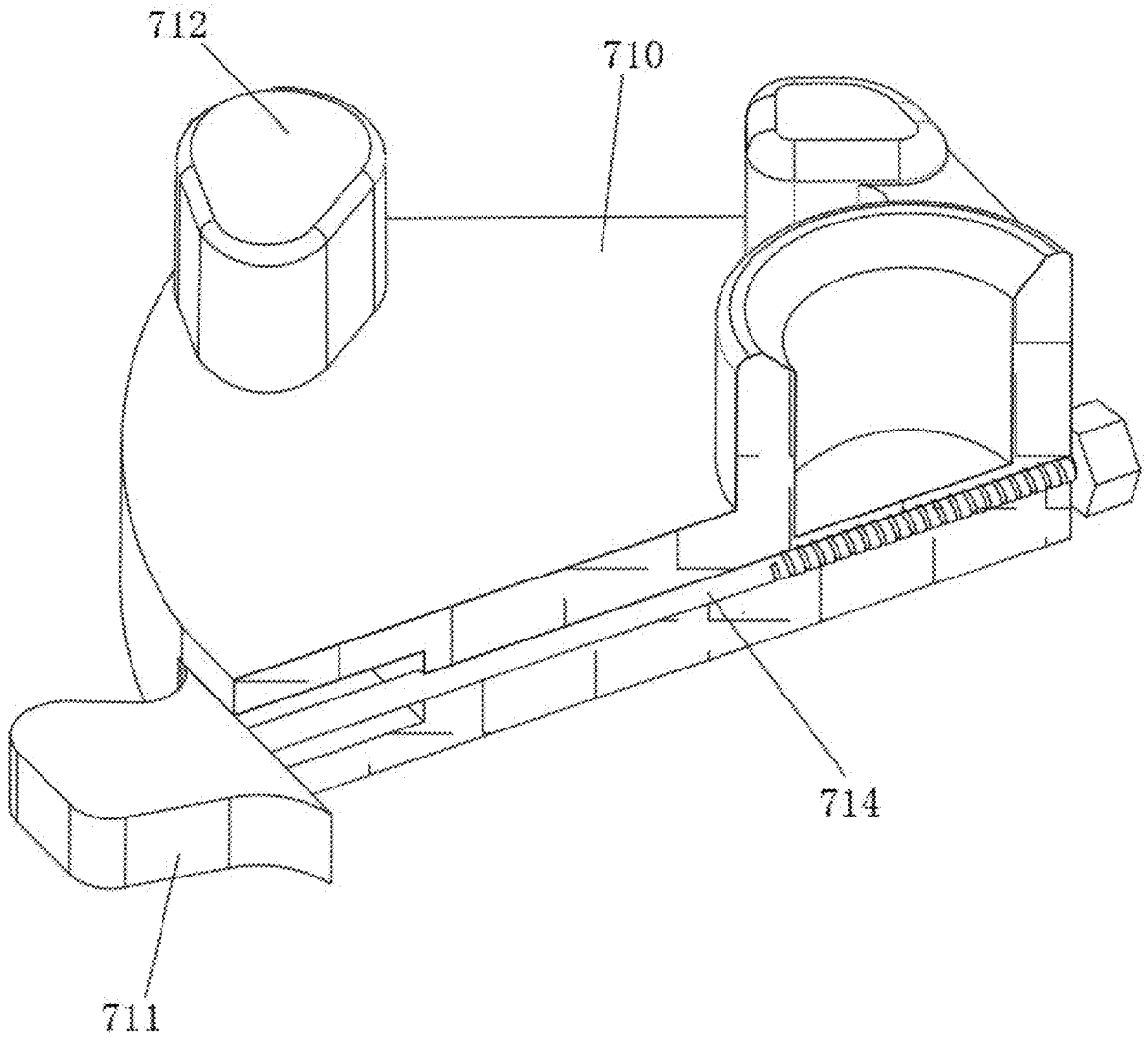
FIG. 5 shows a schematic diagram of an interior structure of a swing arm in accordance with some embodiments of the present disclosure.

Referring to FIG. 5, in some other embodiments of the present disclosure, the interior of the swing arm 710 is threadable connected with a screw 714 that being rotatably connecting with the risen mouldings 711. By rotating the screw 714 to make the risen mouldings 711 move away from the second turntable 320, so that the clamping component 700 will no longer control the rotation of the second turntable 320. This makes it convenient for the winding component 300 to release the data cable for long distances, meeting the requirement of pulling out the data cable for long distances in special situations that away from power sockets.

In the present disclosure, the clamping component 700 is the clamping structure disclosed in the Chinese patent CN215732537U titled "unidirectional free-pulling data cable", and its detailed operating principle shall not be repeated herein.

For one of ordinary skill in the art, it is obvious that the present disclosure is not limited to the details of the above exemplary embodiments, and can be implemented in other specific forms without departing from the concept or essential features of the present disclosure. Therefore, from any point of view, the embodiments should be regarded as exemplary and non-limiting, and the scope of the present disclosure shall be limited by the appended claims rather than the description above. Accordingly, it is intended to encompass all variations falling within the meaning and scope of the equivalent elements of the claims within the scope of present disclosure. Any reference numerals in the claims should not be regarded as limiting the claims involve.

In addition, it should be understood that although this specification is described according to the embodiments, not each embodiment only contains one independent technical solution. Such description in the specification is only for clarity, and one of ordinary skill in the art should consider the specification as a whole. The technical solutions in each embodiment can also be appropriately combined to form other embodiments that one of ordinary skill in the art can understand.

What is claimed is:

1. A retractable data cable, comprising a housing and a conductive component;

wherein the housing comprises a first circuit board, a housing base is fixed on a top of the first circuit board, and a second circuit board is fixed on a top of the housing base;

wherein the conductive component is installed between the first circuit board and the housing base, the conductive component comprises a conductive shaft, and an outer side of the conductive shaft is rotatably sleeved with a conductive carrier; and wherein the retractable data cable further comprises:

a winding component, rotatably connected to a top surface of the first circuit board, wherein the winding component comprises a first turntable and a second turntable, the first turntable and the second turntable are clamped to respectively fix at both ends of the conductive carrier, and a coil spring is installed on the second turntable;

a data cable, wrapped on an outer side of the conductive carrier for fixation;

a plug component, fixedly installed at a leading-out terminal of the data cable, wherein the plug component comprises a fixed sleeve detachably fixed to the data cable, one end of the fixed sleeve is fixedly connected with a protective cover, and one end of the protective cover is fixed with a plug;

a positioning group, installed inside the protective cover and configured to pull the data cable to move into an interior of the fixed sleeve; and a clamping component, disposed in an inner top of the housing base and configured to clamp and fix the winding component being in a rotating state.

2. The retractable data cable according to claim 1, wherein two first convex columns and two second convex columns are fixed on a top surface of the first turntable, and the first convex columns and the second convex columns pass through a conductive holder to fix with the second turntable.

3. The retractable data cable according to claim 1, wherein the interior of the fixed sleeve is slidably snap-fitted with a splint, and an outer side of the fixed sleeve is threadable fastened with a stud being rotated with the splint.

4. The retractable data cable according to claim 1, wherein the positioning group comprises:

a base, fixed on the interior of the protective cover, wherein two first rollers and two second rollers are rotatably provided on a top surface of the base, and the data cable is wound between the first rollers and the second rollers for transmission;

a shaft, rotatably inserted with a corresponding second roller, wherein a wedge block is fixedly sleeved on an outer side of the shaft;

a latch, sliding engaged with the wedge block; and a telescopic rod, provided with two, wherein an output end of the telescopic rod is fixed to the latch, and another end of the telescopic rod is fixed to the protective cover.

5. The retractable data cable according to claim 1, wherein a magnet is fixed on an outer side of the housing base, and an iron sheet is fixedly embedded on an outer side of the plug.

6. The retractable data cable according to claim 1, wherein a connecting shaft is rotatably connected to a top of the conductive shaft, an inner side of the second turntable is fixed with a pillar, and two ends of the coil spring are fixedly connected to the connecting shaft and the pillar, respectively.

7. The retractable data cable according to claim 6, wherein the winding component further comprises a drive column fixedly fastened with the connecting shaft, and the drive column passes through one end of the second circuit board to slidably connect with a slider.

8. The retractable data cable according to claim 1, wherein the clamping component comprises:

a swing arm, rotatably installed at an inner top of the housing base, wherein an outer side of the swing arm is slidably engaged with risen mouldings, and a top surface of the swing arm is fixed with a first lug and a second lug;

a flexure piece, fixed on a top of the swing arm; and a rotating wheel, rotatably installed between the first lug and the second lug.

9. The retractable data cable according to claim 8, wherein an outer side of the second turntable is provided with a plurality of notches movable snap-fitted with the risen mouldings, and an interior of the swing arm is threadable fastened with a screw rotatably connected with the risen mouldings.

10. The retractable data cable according to claim 9, wherein the rotating wheel is rotatably connected to the inner top of the housing base, and an outer side of the rotating wheel is provided with first slots and second slots.

* * * * *